United States Patent [19]

Borges

[11] Patent Number: 4,929,288

[45] Date of Patent: May 29, 1990

[54] CORROSION AND ABRASION RESISTANT ALLOY

[76] Inventor: Robert J. Borges, 14130 Parliament Dr., Chesterfield, Mo. 63017

[21] Appl. No.: 140,740

[22] Filed: Jan. 4, 1988

[51] Int. Cl.[5] ..... C22C 38/22

[52] U.S. Cl. ..... 148/326; 420/67; 420/101; 420/100

[58] Field of Search ..... 148/321, 324, 138, 325, 148/326; 420/15, 61, 67, 12, 100, 101

[56] References Cited

U.S. PATENT DOCUMENTS

| | | | |
|---|---|---|---|
| 2,185,987 | 1/1940 | Parsons et al. | 75/125 |
| 2,212,496 | 8/1940 | De Vries | 75/128 |
| 2,311,878 | 2/1943 | Schlumpf | 76/101 |
| 2,323,120 | 5/1943 | Cooper | 75/126 |
| 2,905,577 | 9/1959 | Harris et al. | 148/326 |
| 2,938,786 | 5/1960 | Johnson | 75/171 |
| 3,165,400 | 1/1965 | Roy et al. | 75/126 |
| 3,250,612 | 5/1966 | Roy et al. | 75/126 |
| 3,565,611 | 2/1971 | Economy | 75/171 |
| 3,758,296 | 9/1973 | Johnson | 75/122 |
| 3,813,239 | 5/1974 | Flint et al. | 75/122 |
| 3,817,747 | 6/1974 | Schultz et al. | 75/171 |
| 3,844,774 | 10/1974 | Culling | 75/134 F |
| 3,876,475 | 4/1975 | Rampquist | 148/37 |
| 3,892,541 | 7/1975 | Forbes Jones | 29/196.1 |
| 3,893,851 | 7/1975 | Culling | 75/171 |
| 3,941,589 | 3/1976 | Norman et al. | 75/125 |
| 3,947,266 | 3/1976 | Culling | 75/170 |
| 4,033,767 | 7/1977 | Johnson | 75/170 |
| 4,080,198 | 3/1978 | Heyer et al. | 75/125 |
| 4,410,489 | 10/1983 | Asphani et al. | 420/453 |

FOREIGN PATENT DOCUMENTS

| | | | |
|---|---|---|---|
| 38633 | 7/1973 | Australia . | |
| 30784 | 1/1974 | Australia . | |
| 71689 | 11/1977 | Australia . | |
| 667661 | 7/1963 | Canada . | |
| 882039 | 9/1971 | Canada . | |
| 115976 | 7/1926 | Fed. Rep. of Germany . | |
| 2169370 | 7/1973 | France . | |
| 59-179762 | 10/1984 | Japan | 148/321 |
| 60-135556 | 7/1985 | Japan | 420/12 |
| 116297 | of 1939 | U.S.S.R. . | |
| 362975 | 1/1932 | United Kingdom . | |

*Primary Examiner*—Deborah Yee

*Attorney, Agent, or Firm*—Cohn, Powell & Hind

[57] ABSTRACT

A white iron alloy exhibits enhanced combined corrosion and abrasion resistance in hot slurries, such as those formed in the production of raw phosphoric acid. The alloy may contain from between about 0.75% to 1.5% carbon, between about 2.0% to 2.5% manganese, between about 2.0 to 3.0% molybdenum, between about 1.0% to 2.0% copper, up to about 0.85% silicon, between about 0.5% to 1.0% tungsten, between about 24 to 30% chromium and the balance being iron along with normal residual elements. The alloy may be cast and is age hardenable.

18 Claims, No Drawings

CORROSION AND ABRASION RESISTANT ALLOY

BACKGROUND OF THE INVENTION

This invention relates to a cast alloy having combined corrosion and abrasion resistance.

Applicant is aware of the following U.S. patents, the disclosures of which are incorporated by reference herein: U.S. Pat. Nos. 2,212,496; 2,311,878; 2,323,120; 3,165,400; 3,250,612; 3,876,475 and 3,941,589, and United Kingdom No. 362,975 of 1931.

Equipment used in corrosive environments is typically constructed of stainless steel or other high alloy materials. These alloys provide excellent service in clear fluids. However, when subjected to a corrosive slurry, fluid containing abrasive solids, under moderate to high velocity, these materials perform poorly due to poor abrasion resistance.

Equipment used in abrasive slurry environments is typically constructed of wear resistant irons. Wear resistant irons provide excellent service in neutral slurries. However, if the slurry becomes mildly acidic, these materials fail in short order due to inadequate corrosion resistance.

The alloy of this invention provides superior combined corrosion and abrasion resistance for handling acidic slurries.

An application requiring such a material is the production of wet process prosphoric acid. The initial step in the process is the reaction of raw phosphate ore with concentrated sulphuric acid. Products of the reaction are phosphoric acid and calcium sulphate, along with both chemical and solid impurities. A typical product slurry analysis is 42% phosphoric acid, up to 1% chlorine and fluorine impurities, approximately 2.5% sulphuric acid, and 30 to 40% solids. The solids are mostly calcium sulphate and siliceous gangue (which is highly abrasive). The operating temperature for raw acid formation, and the slurry temperature, is usually above 50° C., typically 80° C. The alloy of the invention can be expected to offer significantly improved life compared to either stainless steels or wear resistant irons for fluid handling equipment and filtration equipment in this environment.

The advantages of applicant's invention are achieved by a cast, high chromium, ferritic, white iron alloy possessing combined corrosion and abrasion resistance in both the as-cast and age hardened condition. Typically the alloy contains from between about 0.75% to 1.5% carbon, up to about 0.85 silicon, between about 2.0% to 2.5% manganese, between about 2.0% to 3.0% molybdenum, between about 1.0% to 2.0% copper, between about 0.5% to 1.0% tungsten, between about 24% to 30% chromium and the balance being iron along with normal residual elements. Preferably the alloy contains between about 0.9 to 1.2% carbon, between about 26 to 28% chromium, and between about 0.4 to 0.75% silicon. The silicon content should be kept as low as possible, without reducing the castability of the alloy. Silicon adds fluidity to the alloy melt. However, silicon can reduce the corrosion resistance of the alloy in acidic media, particularly in media contaning halide ions. It is preferred that the silicon level be as low as possible while maintaining good castability in the alloy melt.

The combination of the alloying elements in the specified proportions yields a material having an as-cast microstructure of a high chromium ferritic matrix with approximately 30% of the alloy being a discontinuous complex phase. The discontinuous phase contains high alloy chromium, molybdenum and tungsten carbides which provide extreme hardness and abrasion resistance to the alloy. The abrasion resistance can be further enhanced, with little or no loss in corrosion resistance, by a low temperature age hardening heat treatment. The alloy in either the as-cast or age-hardened condition possesses excellent combined corrosion and abrasion resistance. The alloy is readily castable by standard foundry practice, and has adequate strength and ductility suitable for mechanical rotating equipment.

It is thus an object of applicant's invention to provide an alloy for use in acid slurries.

It is an object of applicant's invention to provide an alloy which is resistant to the environments common in the wet process production of phosphoric acid.

It is an object of applicant's invention to provide an alloy which is resistant to abrasive conditions as found in hot slurries.

It is an object of applicant's invention to provide an alloy which has combined abrasion and corrosion resistance.

It is a further object of applicant's invention to provide a white iron alloy which has mixed abrasion and corrosion resistance.

It is an object of applicant's invention to produce a white iron alloy having a ferritic matrix.

It is a further object of applicant's invention to provide a white iron alloy having a dispersed phase in a ferritic matrix, the dispersed phase containing carbides of chromium, tungsten and molybdenum and producing an alloy having high resistance to combined corrosive and abrasive conditions.

It is a further object of applicant's invention to provide a white iron alloy having corrosion resistance and abrasion resistance which is castable and hardenable.

DESCRIPTION OF THE PREFERRED EMBODIMENTS

The alloy of the invention is a high chromium white cast iron. The alloy contains between about 0.75% to 1.5% carbon, between about 2.0% to 2.5% manganese, up to about 0.85% silicon, between about 24% to 30% chromium, between about 2.0% to 3.0% molybdenum, between about 1.0% to 2.0% copper, between about 0.5% to 1.0% tungsten, and the balance iron with minor amounts of typical residual elements, such as sulphur and phosphorous. It will be appreciated that the amount of residues, such as sulphur, phosporous and like materials is kept below the level at which they would have a deleterious effect on the properties of the alloy. Preferably the aggregate of all such trace materials is below about 0.2%.

The principal alloying element of the white cast iron alloy, after iron, is chromium which is typically present at between about 24% to 28% by weight, preferably 26% to 28%. A portion, typically 6–8%, based on the total alloy weight, of the chromium is present as complex, extremely hard chromium carbides, approximately 1400 Vickers hardness, providing abrasion resistance. The balance of the chromium is present in the matrix in solid solution, at a relatively high level of approximately 20%, based on the total alloy weight, which provides corrosion resistance in oxidizing environments.

Carbon content is maintained at a level of between about 0.75% to 1.5%. It is preferred that the carbon content be between about 0.9 to 1.2%, and preferably toward the low end of this range. Too high a carbon level results in the presence of a dual phase matrix, the second phase being pearlite or austenite, which can be subsequently transformed to martensite, all of which exhibit poor corrosion resistance. Carbon contents below about 0.75 to 0.9% promotes a continuous carbide network which impairs ductility.

The molybdenum content is maintained at a level of between about 2.0% to 3.0%. Molybdenum is a strong carbide former and reacts with carbon preferentially to chromium, thus freeing greater amounts of chromium for the matrix. Molybdenum carbides are extremely hard, approximately 1500 Vickers hardness, and improve the abrasion resistance. A portion of the molybdenum content, between about 1.8 and 2.7%, based on the total alloy weight, is found in the matrix, between about 0.2 to 0.3% by weight, based on the total alloy weight, is present in the dispersed phase. The presence of molybdenum in the matrix greatly enhances the general corrosion resistance and provides resistance to pitting corrosion in environments containing halide impurities.

A copper content of between about 1.0% to 1.5%, based on the total weight of the alloy, is found in the matrix. The remaining copper is found in the dispersed phase. Copper is known to improve the corrosion resistance in oxidizing environments, such as phosphoric and sulphuric acid.

Tungsten addition of between about 0.5% to 1.0% promotes the formation of hard tungsten carbide, approximately 2400 Vickers hardness, which greatly improves abrasion resistance. Tungsten forms carbide in preference to chromium, releasing additional chromium to the matrix and, thus, improving the corrosion resistance. A portion of the tungsten content, between about 0.4 to 0.8% of the total alloy, is found in the matrix. Between about 0.1 to 0.2% of the tungsten, based on the total alloy, is found in the dispersed phase. The tungsten may also be involved in the precipitation hardening reaction.

The remainder of the alloy consists of iron and residual elements and impurities, such as phosphorous and sulphur.

As-cast alloy exhibits a two phase structure having a ferritic matrix and a discontinuous phase containing high alloy metal carbides, primarily chromium, molybdenum and tungsten carbides. The discontinuous phase is between about 20 to 40% of the total alloy, preferably about 30%. The as-cast alloy exhibits excellent combined corrosion abrasion resistance in applications such as pumping of slurries of acidified phosphate ore. The alloy may also be suitable for service where resistance to galling is of importance.

The alloy may be hardened with a low temperature precipitation hardening heat treatment, for example at about 2 to 4 hours at about 600° F. to 1800° F. Applicant's material shown in Tables II and III was hardened at about 900° F. for about six hours. The hardened alloy provides improved abrasion resistance with little or no loss in corrosion resistance. Hardness varies from 30 to 40 Rockwell C.

The following table show examples of alloys made within the concepts of the invention compared with conventional alloys. CF8M and CD4MCu alloys are commercially available cast stainless steel alloys. The 15Cr-3Mo iron is a commercially available cast abrasion resistant iron; it was quenched and tempered to 65 Rockwell C hardness.

Experimental material shown in Table IA was made in a conventional electric furnace by melting the ingredients together in the proper proportions, deoxidizing and casting test material using conventional gravity casting techniques. The cast material was subjected to the tests shown in Tables II and III.

Table II summarizes the comparison of corrosion testing of these alloys in the environment noted in Table II. The alloys were prepared as conventional test blanks and subjected to a series of corrosion tests. A series was tested in phosphoric acid at 90° C. The test was run for 96 hours. The phosphoric acid was a crude phosphoric acid typical of acids used in producing phosphate fertilizer using Florida phosphate rock. The acid contained approximately 1.25 percent fluoride ion in 42 percent $H_3PO_4$. This acid composition is typical of those which would be encountered in phosphoric acid environments.

As can be seen from Table II, applicants' new alloy in particular tested as being comparable to conventional cast materials in static tests. The 42% $H_3PO_4$ solutions are typical of environments encountered in phosphoric acid production.

In Table III a number of alloys were subjected to the combined effects of corrosion and abrasion. Testing was done in a laboratory test stand. Test samples were cast four blade propellors with a diameter of approximately 9 inches. Each propellor was rotated in an acidic slurry at 578 RPM, which resulted in a tip speed of 22.7 Ft/Sec. Slurry analysis was: 20% by weight solids ($SiO_2$), 2.5% sulphuric acid (pH=0). Testing temperature was 50° C. Test duration was 24 hours. As can be seen, the alloy exhibits greatly superior resistance to corrosion and abrasion in acidic slurries.

Evaluation of the castability of the experimental alloys was made by making experimental castings of the general type used in this service. These included pump casings. The molten metal exhibited adequate fluidity filling all voids in the molds.

Various changes and modifications may be made within the purview of this invention, as will be readily apparent to those skilled in the art. Such changes and modifications are within the scope and teachings of this invention as defined by the claims appended hereto. The invention is not to be limited by the examples given herein for purposes of illustration, but only the scope of the appended claims and their equivalents.

TABLE IA

| | Summary-Experimental Heats Analysis Weight Percent | | | | | |
|---|---|---|---|---|---|---|
| Element | N3596 | S525 | S644 | N6977 | N7038 | R0172 |
| Carbon | 1.45 | 1.04 | 1.29 | 1.09 | 1.14 | .97 |
| Mn | 2.40 | 2.38 | 2.52 | 2.21 | 2.19 | 2.34 |
| P | .008 | .020 | .021 | .014 | .016 | .020 |
| S | .012 | .017 | .017 | .017 | .016 | .018 |
| Si | .85 | .68 | .70 | .73 | .74 | .78 |
| Cr | 27.96 | 27.71 | 26.30 | 27.39 | 26.53 | 27.15 |
| Ni | .16 | .20 | .23 | .19 | .20 | .27 |
| Mo | 2.03 | 3.00 | 2.50 | 2.68 | 2.50 | 2.78 |
| Cu | 1.27 | 1.23 | 1.01 | .99 | 1.06 | 1.22 |
| W | .60 | .62 | .69 | .66 | .80 | .65 |
| Fe | Bal | Bal | Bal | Bal | Bal | Bal |

TABLE IB

| Analysis of Other Alloys Tested - Weight Present | | | |
|---|---|---|---|
| Element | CD4MCu | CF8M | 15Cr—3Mo Iron |
| C | .21 | .06 | 2.78 |
| Mn | .78 | .70 | .59 |
| P | .032 | NA | .011 |
| S | .013 | NA | .049 |
| Si | .59 | 1.57 | .55 |
| Cr | 27.67 | 18.72 | 15.81 |
| Ni | 8.05 | 9.26 | — |
| Mo | 2.19 | 2.29 | 1.80 |
| Cu | 3.37 | .55 | — |
| Fe | Bal | Bal | Bal |

TABLE II

| Static Corrosion Laboratory Tests in 42% $H_3PO_4$ and 98% $H_2SO_4$ Rates-mils per year (0.001 inch per year) | | | |
|---|---|---|---|
| Material | Heat Treatment | $H_3PO_4$ | $H_2SO_4$ |
| N3695 | As Cast | 3.2 | 4.2 |
| N3596 | Hardened | 3.5 | — |
| S525 | As Cast | 4.5 | 12.7 |
| S525 | Hardened | 1.0 | — |
| N6977 | As Cast | 0.6 | |
| N6977 | Hardened | 2.0 | — |
| N7038 | As Cast | 1.5 | |
| N7038 | Hardened | 4.4 | — |
| CF8M | Soln Annealed ASTM-A743, Grade CF8M | 0.2 | 20.0 |
| CD4MCu | Soln Annealed ASTM-A743, Grade CD4MCu | 1.0 | 1.7 |

TABLE III

| Dynamic Corrosion Abrasion Tests Rates-mils per year (0.001 inch per year) | | |
|---|---|---|
| Material | Heat Treatment | Rate |
| N6977 | As Cast | 160 |
| | Hardened | 92 |
| N7038 | As Cast | 110 |
| | Hardened | 94 |
| R0172 | As Cast | 131 |
| | Hardened | 101 |
| S525 | As Cast | 86 |
| | Hardened | 83 |
| S644 | As Cast | 166 |
| | Hardened | 137 |
| CF8M | Soln Anneal, ASTM-A743, Grade CF8M | 250 |
| CD4MCu | Soln Anneal, ASTM-A743, Grade CD4MCu | 209 |
| 15Cr—3Mo Wear Resistant Iron | Hardened, quenched and tempered ASTM-A532, Class II, type C | 12,037 |

I claim:

1. In a white iron alloy the improvement comprising a high chromium iron base having a ferritic matrix containing a dispersed phase, the alloy containing a dispersed phase, the alloy containing between about 26 to 28% chromium, between about 0.9 to 12% carbon, between about 0.4 to 0.75% silicon and between about 0.5 to 1.0% tungsten, and a portion of the tungsten being present in the dispersed phase, the alloy having substantial resistance to combined corrosion and abrasion in hot acid slurries.

2. The alloy of claim 1 wherein the alloy contains between about 24 to 30% chromium. The alloy of claim 2 wherein the alloy contains chromium in the ferritic matrix at a level of up to about 20% by weight of the total alloy composition.

3. The alloy of claim 2 wherein the alloy contains chromium in the dispersed phase at a level of about 6–8% by weight of the total alloy composition.

4. The alloy of claim 1 wherein the tungsten in the dispersed phase is present, at least in part, as tungsten carbides.

5. The alloy of claim 1 wherein the alloy contains chromium and molybdenum in the dispersed phase.

6. The alloy of claim 5 wherein the chromium and molybdenum in the dispersed phase are present, at least in part, as carbides.

7. The alloy of claim 1 wherein the alloy is hardenable.

8. The alloy of claim 1 wherein the alloy is castable.

9. The alloy of claim 1 wherein the alloy contains up to about 0.85% silicon.

10. The alloy of claim 1 wherein the alloy contains between about 26 to 28% chromium, between about 0.9 to 1.2% carbon, between about 0.4 to 0.75% silicon, between about 2.0 to 2.5% manganese, between about 2.0 to 3.0% molybdenum, between about 1.0 to 2.0% copper, up to about 0.2% trace elements and the balance being iron.

11. A white iron alloy having a high chromium iron base, the alloy having a ferritic matrix containing a dispersed phase, the dispersed phase being about 20 to 40% of the total alloy and containing dispersed high alloy carbides, the alloy containing between about 24 to 30% chromium, between about 0.5 to 1.0% tungsten, between about 2.0 to 3.0% molybdenum, between about 2.0 to 2.5% manganese between about 1.0 to 2.0% copper, between about 0.75 to 1.5% carbon and up to about 0.85% silicon.

12. The alloy of claim 11 wherein the alloy contains between about 26 to 28% chromium.

13. The alloy of claim 11 wherein the alloy contains between about 0.9 to 1.2% carbon.

14. The alloy of claim 11 wherein the alloy contains between about 0.4 to 0.75% silicon.

15. The alloy of claim 13 wherein the alloy contains about 20% chromium, based on the total alloy weight, in the ferritic matrix.

16. The alloy of claim 11 wherein the alloy contains between about 6 to 8% chromium, based on the total alloy weight, in the dispersed phase, at least a part of the chromium in the dispersed phase being present as chromium carbides.

17. The alloy of claim 11 wherein the alloy contains tungsten and molybdenum in the dispersed phase, at least a part of the tungsten and molydbenum being present as carbides.

18. The alloy of claim 11 wherein the alloy contains about 28% chromium, about 3% molybdenum, about 2.4% manganese, about 1.25% copper, about 1% carbon, about 0.6% tungsten, and about 0.7% silicon, the alloy being castable and hardenable.

* * * * *

UNITED STATES PATENT AND TRADEMARK OFFICE

CERTIFICATE OF CORRECTION

PATENT NO. : 4,929,288

DATED : May 29, 1990

INVENTOR(S) : Robert J. Borges

It is certified that error appears in the above-identified patent and that said Letters Patent is hereby corrected as shown below:

Column 1, line 63, delete "contaning" and insert --containing-

Column 5, line 57, delete "12%" and insert --1.2%--

Column 6, lines 3 to 5, delete --The alloy of claim 2 wherein the alloy contains chromium in the ferritic matrix at a level of up to about 20% by weight of the total alloy composition.--

Column 6, line 62, add, --19. The alloy of claim 2 wherein the alloy contains chromium in the ferritic matrix at a level of up to about 20% by weight of the total alloy composition.--

Signed and Sealed this

Tenth Day of September, 1991

*Attest:*

*Attesting Officer*

HARRY F. MANBECK, JR.

*Commissioner of Patents and Trademarks*